US010580384B1

(12) United States Patent
Woodall

(10) Patent No.: US 10,580,384 B1
(45) Date of Patent: Mar. 3, 2020

(54) PANEL CALIBRATION USING MULTIPLE NON-LINEAR MODELS

(71) Applicant: PIXELWORKS, INC., Portland, OR (US)

(72) Inventor: Neil Woodall, Newport Beach, CA (US)

(73) Assignee: PIXELWORKS, INC., Portland, OR (US)

( * ) Notice: Subject to any disclaimer, the term of this patent is extended or adjusted under 35 U.S.C. 154(b) by 28 days.

(21) Appl. No.: 15/946,261

(22) Filed: Apr. 5, 2018

(51) Int. Cl.
*G09G 5/02* (2006.01)

(52) U.S. Cl.
CPC ..... *G09G 5/02* (2013.01); *G09G 2320/0209* (2013.01); *G09G 2320/0666* (2013.01); *G09G 2320/0693* (2013.01)

(58) Field of Classification Search
CPC ..... G09G 5/02; G09G 2320/0209; G09G 2320/0214; G09G 2320/0693; H04N 5/359; H04N 5/21; H04N 5/213; H04N 13/327
See application file for complete search history.

(56) References Cited

U.S. PATENT DOCUMENTS

2010/0128050 A1* 5/2010 Chou ..... G09G 3/3607 345/589

OTHER PUBLICATIONS

Cho et al. "Inverse Characterization Method of Alternate Gain-Offset-Gamma Model for Accurate Color Reproduction in Display Device", Journal of Imaging Science and Technology 50(2) 139-148, 2006. (Year: 2006).*

* cited by examiner

*Primary Examiner* — Antonio A Caschera
(74) *Attorney, Agent, or Firm* — Miller Nash Graham & Dunn LLP

(57) ABSTRACT

A method of calibrating a display panel including making measurements of color components displayed on the display panel, using the measurements to generate at least two non-linear models for each color component, receiving an input image consisting of one or more pixels represented by input color values, calculating a crosstalk gain for a given value of the color components using the generated non-linear models and the input values of a pixel, applying the crosstalk gain to the color components of the pixel to create crosstalk compensated component values, and displaying an image using the crosstalk compensated component values.

13 Claims, 6 Drawing Sheets

PANEL CALIBRATION USING MULTIPLE NON-LINEAR MODELS

BACKGROUND

Historically, displays were manufactured to meet the requirements of a video color standard and the video color standard was developed based on the feasibility of manufacturing such a display. A display might be required to display two different video types, for example, High Definition (HD) defined by the International Telecommunications Union-Radio Communications (ITU-R) Recommendation BT.709, or standard definition as defined by ITU-R Recommendation BT.601. The differences between the two standards were minor and typically handled by a simple 3×3 matrix conversion.

However, with advent of digital photography, additional color standards arose that allowed the display of a wider range of colors (wide gamut), and manufacturers created displays that also displayed a wide gamut. One method of displaying a wide gamut employs Organic Light Emitting Diode (OLED) displays.

Both OLED and LCD displays share a similar active matrix architecture. The display will have an integrated circuit (display driver IC or DDIC) that converts the Red-Green-Blue (RGB) digital input and drives a voltage or current to an active circuit element at each pixel. The active circuit element will keep that voltage or current active for the pixel until the next time it updates. Crosstalk can result because of coupling between the traces connecting the display driver to the pixels or because of interactions between the color subpixels. Crosstalk decreases the color accuracy making it an unwanted attribute of a display.

Unfortunately, OLED displays require more complex circuitry than an LCD display to produce an image, and sampling and keeping an accurate current value is more difficult than a voltage. Therefore, non-linear cross talk can exist between the color channels. Because of the non-linearities in the cross talk, calibration of OLED displays requires a larger number of color measurements than an LCD display for accurate results in calibration.

Current methods for calibrating a display for different color standards involve measuring the white and pure RGB colors in terms of the XYZ values. The methods use the XYZ values because they are device invariant and provide a quantitative link between the spectral distribution of the color the physiological perception of the color. The methods normalize the measurements to create xy.

$$x=X/(X+Y+Z)$$

$$y=Y/(X+Y+Z).$$

The xy coordinates allow calculation of the correct color space conversion matrix from a device independent color in this case XYZ, to a device dependent color, such as RGB. All the color standards are described using a set of xy coordinates for RBG and W that allows the calculation of the color space conversion matrix to go from the color standard RGB values to the device independent XYZ colors. The combination allows one to convert from the input color standard RGB value to the display RGB value so that regardless of the display gamut the correct colors are viewed.

Another aspect of the color standard and the displays involves the shape of the non- linear function between the RGB values at the input and the amount of RGB light emitted from the display. The Electrical to Optical Transfer Function (EOTF) also needs to be matched between the display and the standard for the image to look correct. Because of this, the standard will specify an EOTF based on a variety of factors and it is up to the display to make sure what is implemented matches the standard so that the image looks correct Typical methods for the calibration of panels take hundreds of measurements and then interpolate between those measurements without considering the properties of the panel or the display technology. This takes time and has too high of a cost of implementation on the production line. A need exists to provide accurate calibration of displays with fewer measurements on a production line.

DETAILED DESCRIPTION OF THE EMBODIMENTS

Figure 1:
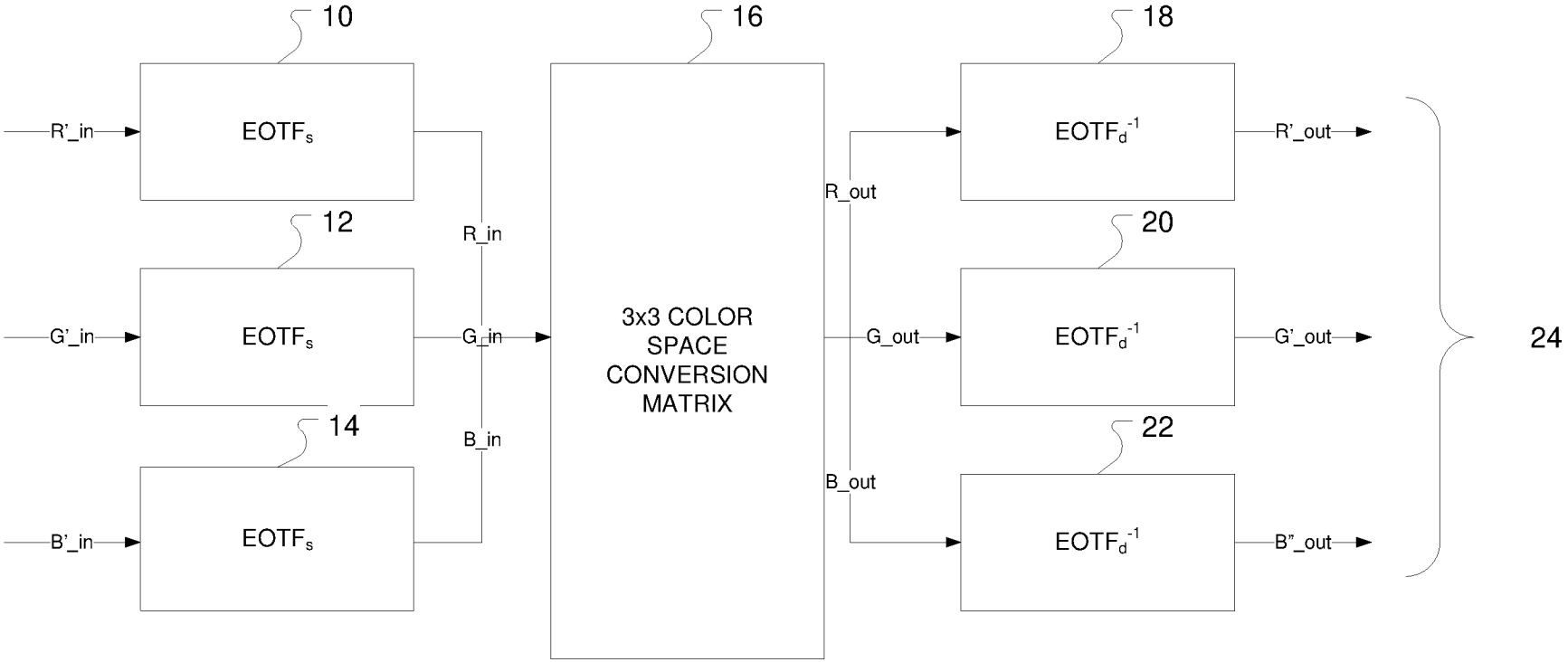
FIG. 1 shows an example of a current method of converting from an input standard color space to an output display color space.

In the below discussion, different notations will use subscripts to identify different colors being measured and displayed. The letters R, G, B, without any mark represent those colors in linear space. In contrast, R', G', and B' represent those colors in non-linear space. The subscript notations used designate a color or colors being displayed. For example, the subscript notation 'rr' represents the red value when red is being displayed, 'rg' represents the red value when both red and green (yellow) are being displayed, and 'rb' represents the red value when both red and blue (magenta) are being displayed. The subscript notation with 'w' as the second letter is for the color when white is being displayed. A single letter subscript on the linear or non-linear colors designate that color value when also displaying the subscript color, for example Rg represents the linear color red when red and green (yellow) is being displayed.

Typically a system is used to calibration display panels. The display electronics may be included the DDIC mentioned above located on the panel itself or as part of an integrated circuit separate from the display. In a first scenario, the non-linear models may be calculated and stored in a 3D LUT using an external device that is connected to the colorimeter. The display device then applies the calculated model to the pixel data before sending it to the display. Another scenario is for unprocessed values from the colorimeter to be communicated to the display. For example, if the display is already integrated into a device, this minimizes the amount of time required for calibration on the factory line. Because so few measurements are required to calibrate the panel the colorimeter could also generate a barcode that is attached to the display that the final display electronics could read. Finally, the values themselves can be stored in the DDIC. When the final product is turned on for the first time, the display electronics can read the values produced by the colorimeter and generate the non-linear models. Another scenario allows the display electronics at calibration to be different than what is used in the actual device A calibration process may do some of the calibration steps before writing the data to the display. One reason to do this is so that the color measurements can produce a generic type of file so that any additional processing done at the SOC (System on a Chip) does not have to be modified based on the type of display technology or number of measurements made. When measuring, some calculations are done to the raw XYZ data before storing the data on the display. The XYZ data is received from the colorimeter and the chromaticities of the primary colors and white are calculated. Using the chromaticities, the normalized RGB values are calculated from the XYZ data so that the gamma values (or Electronic to Optical Transfer Function, EOTF) can be calculated. Typically, only the gamma values when displaying white are initially calculated. The delta gray values are the differences between the measured output and the output predicted by just using a non-linear model for white. This then creates a set of values that can be stored on the display and read by the system on a chip (SOC) in a tablet or computer.

The SOC then calculates the rest of the non-linear models when displaying red, green, blue, cyan, yellow and magenta. Depending on the hardware configuration as will be described below, it may also compute the crosstalk gains 1D LUT and generate fine gamma correction and stores them in memory organized as an internal color space matrix format that represents the output display color space. Each of the input color spaces such as aRGB, bt.709, bt.601, etc., are also converted to the same internal color space matrix format. It then uses the display panel internal color space matrix and the input color internal color space matrix to create 3D and 1D lookup tables. This overview is discussed in more detail below.

FIG. 1 shows an example of a standard method of converting from an input standard color space to an output display color space. Functions 10, 12, and 14 apply the video standard EOTF to each individual component. This creates linear RGB signals, R_In, G_In, and B_In, from non-linear signals R'_In, G'_In, and B'_In. A 3×3 color space conversion matrix 16 converts from the input color space to the display color space, R_Out, G_Out, and B_Out. Another set of functions, 18, 20, and 22 operates on each individual component to generate the non-linear values 24, R'_Out, G'_Out, and B'_Out, using the inverse of the display EOTF.

During calibration of a panel, the usual measurements from the spectrometer or colorimeter describe the measurements in XYZ color space. This occurs because the measurements need to be device independent. As discussed previously, if the process measures the XYZ values for red, green, blue, and white, the process can derive the matrix to convert the XYZ measurements to RGB values. For a well-behaved display, meaning one that acts as expected and within defined parameters, the brightness of a color component for a given input signal remains independent of the other color components. When the input equals R'=1, G'=0, and B'=0, converting the XYZ measurement to R'G'B' using the matrix derived from the matrix results in R'=K, G'=B'=0, where K represents the peak brightness of the display. The inputs R'=G'=B'=1 result in a conversion to R'=G'=B'=K. LCD displays almost exactly follow this relationship.

As discussed above, OLED displays do not follow this relationship due to non-linear cross talk between the color components. It is not unusual for them to display a pure color at a higher intensity than that same color when displaying white. Therefore, they typically require a larger number of color measurements for accurate calibration results.

Typical methods for calibration of panels take hundreds of measurements and then interpolate between those measurements without considering the properties of the panel or the display technology. As mentioned previously, this takes too much time and costs too much to be cost effective on a production line.

Figure 2:
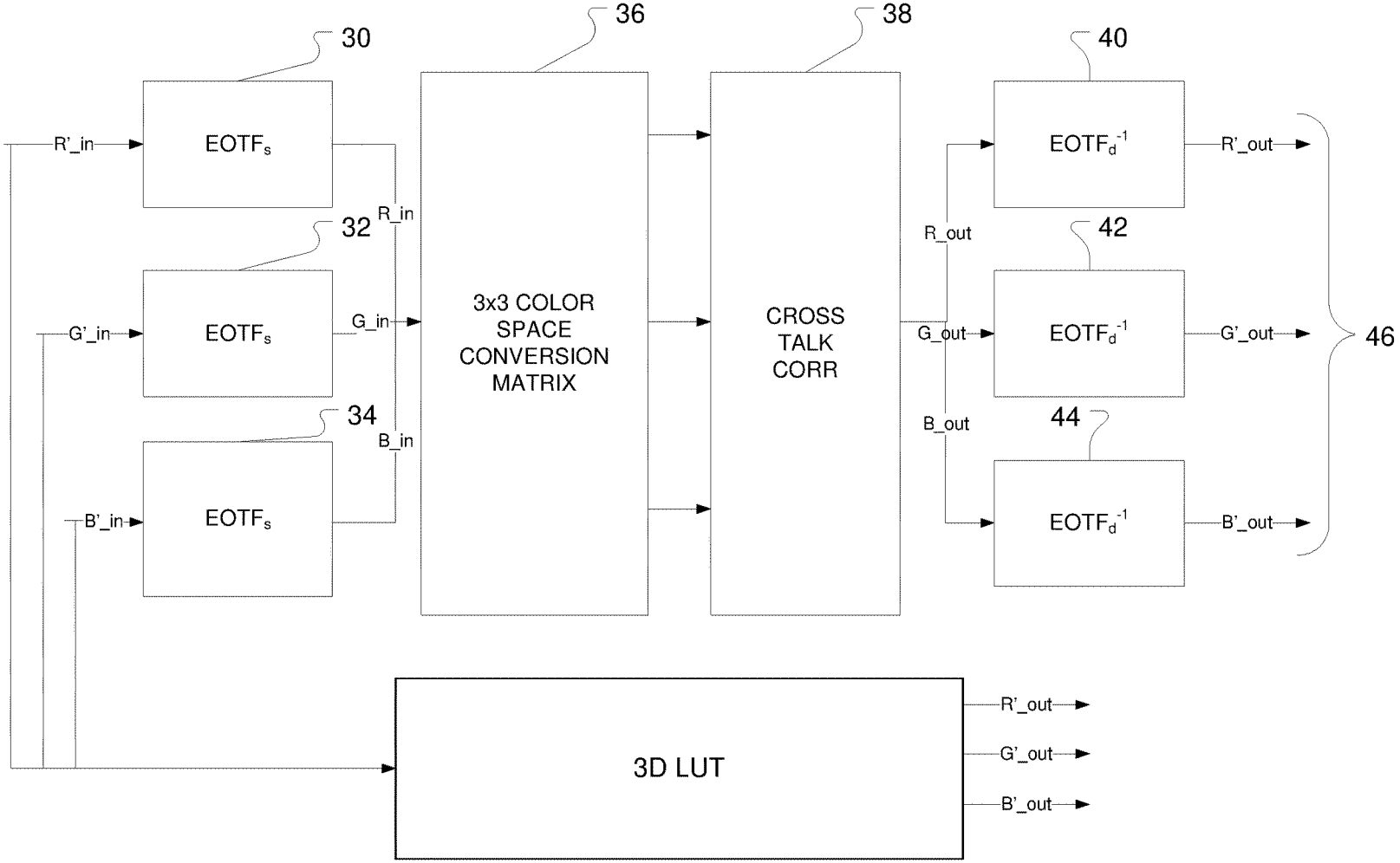
FIG. 2 shows an embodiment of a method of converting from an input standard color space to an output display color space with a crosstalk correction.

The embodiments here provide a cross talk correction function as part of the color standard conversion process as shown in FIG. 2. This allows the crosstalk correction to be remain independent of the input color standard. In FIG. 2, functions 30, 32, and 34, apply the video standard EOTF to each individual component. This creates linear RGB signals, R_In, G_In, and B_In, from non-linear signals R'_In, G'_In, and B'_In. A 3×3 color space conversion matrix 36 converts from the input color space to the display color space. However, instead of the 3×3 matrix generating the linear color space signals, R_Out, G_Out, and B_Out, the output of the 3×3 matrix goes to a crosstalk correction process 38. The crosstalk correction process 38 then outputs the linear color space signals R_Out, G_Out, and B_Out. Another set of functions, 40, 42, and 44 operates on each individual component to generate the non-linear values 46, R'_Out, G'_Out, and B'_Out, using the inverse of the display EOTF.

Figure 3:
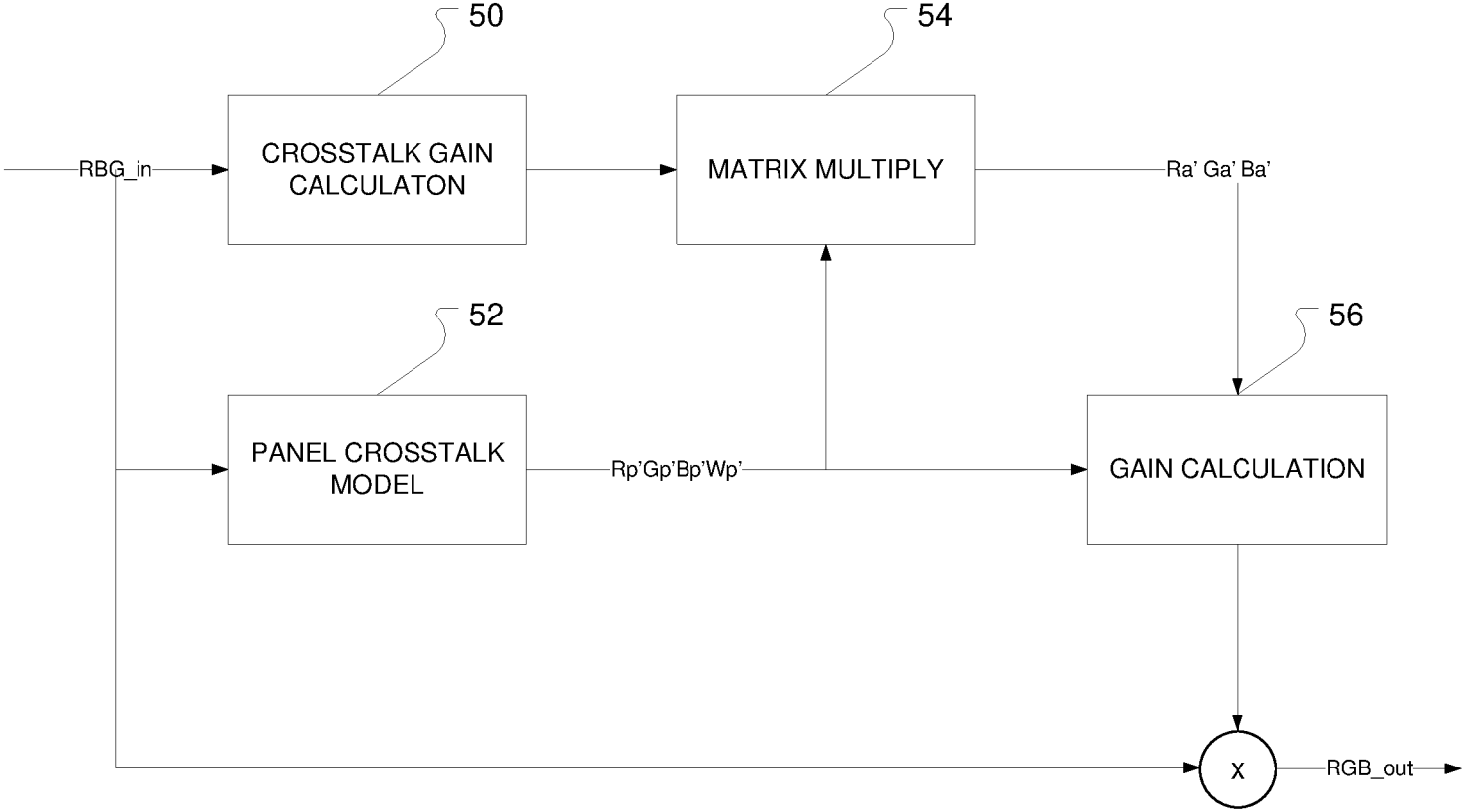
FIG. 3 shows an embodiment of a crosstalk correction function.

The crosstalk correction function in the embodiments here will generally have four parts: a crosstalk gain calculation; a display panel crosstalk model; a matrix multiply; and a linear gain calculation. As shown in FIG. 3, the crosstalk gain calculation and the panel cross talk model receive the linear RGB data from the 3×3 conversion matrix of FIG. 2. The crosstalk gain calculation 50 uses measurements of the panel to produce several EOTFs that are then compared to each other to produce gains that are applied to the output of the panel crosstalk model at the matrix multiply at 54. The panel crosstalk model 52 transforms the linear RGB data input signal non-linear space to model the mechanism behind the crosstalk in the panel. This model depends upon the technology used in the panel and will generally not vary from panel to panel of a same technology. The matrix multiply 54 produces an adjusted crosstalk corrected signal that the system uses to generate an overall gain to apply to the linear RGB input. This results in the crosstalk compensated output. Finally, the data is converted to R'G'B' using the inverse of the EOTF measured for the display.

Figure 4:
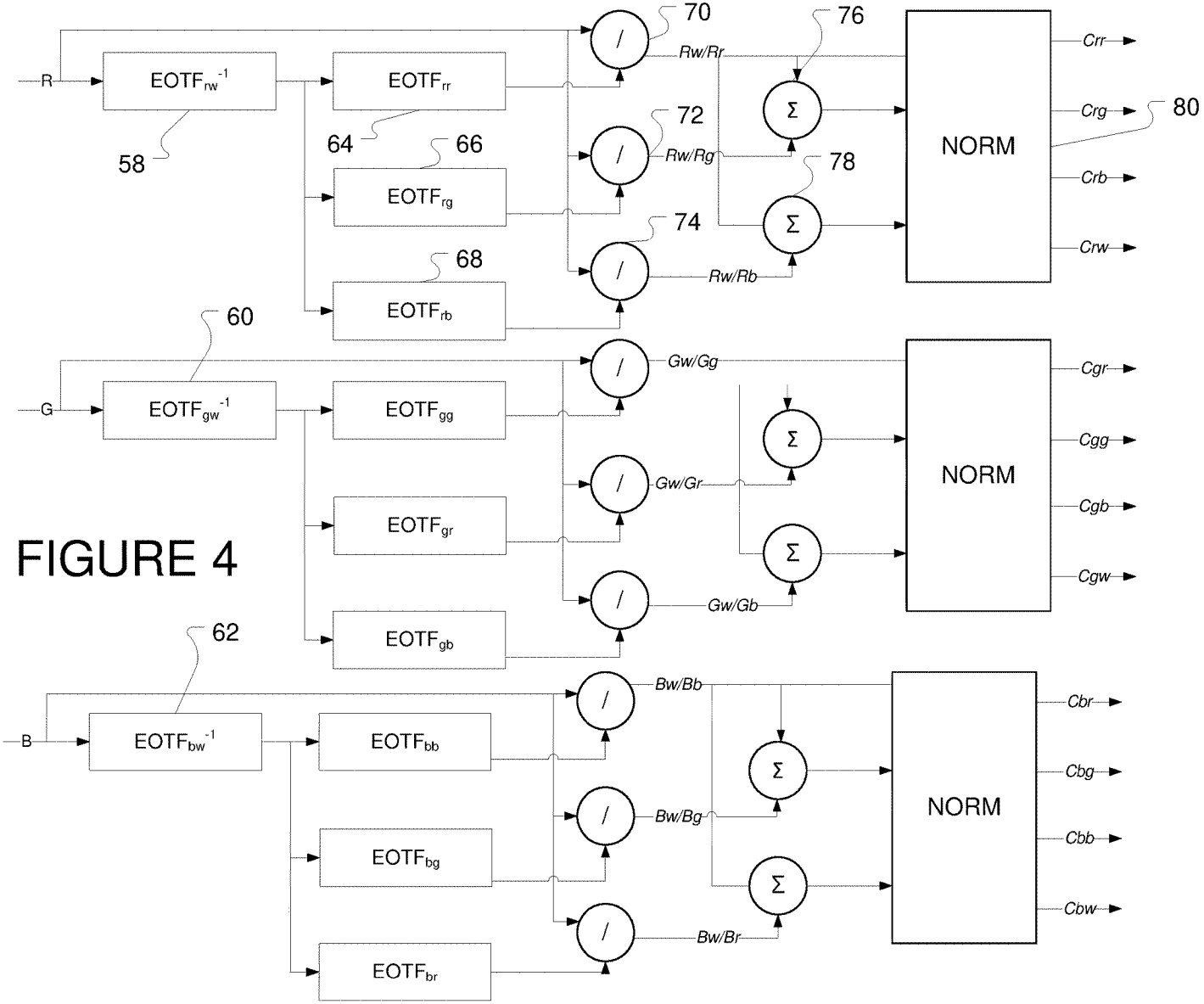
FIG. 4 shows an embodiment of modeling a non-linear response for colors in an input color space.

In the crosstalk gain calculation, the process models the non-linear response or EOTF for each individual color for the 4 different possible settings of the other color components. In the embodiment of FIG. 4, the EOTF is calculated for each color when white is displayed, resulting in $EOTF_{rw}$ 58 for red while displaying white, $EOTF_{gw}$ 60 for green while displaying white, and $EOTF_{bw}$ 62 for blue while displaying white. The function applied is the inverse ($^{-1}$) function initially, then individual EOTFs for each color while displaying that color and then the other color components are applied, such as $EOTF_{rr}$ 64 for red while displaying red, $EOTF_{rg}$ 66 for red while displaying red and green, and $EOTF_{rb}$ for red while displaying red and blue 68. These are repeated for green and blue as well.

The resulting output color is then divided by the color component when displaying white. For red, this is shown at 70, 72, and 74, and is repeated likewise for green and blue. The ratio of the color component to the color when displaying white is then differenced with the other two color components. This is shown at 76 and 78. At 76, for example, the difference between Rw/Rr and Rw/Rg is found and output to the normalizer 80. The normalizer for each color outputs four gain measurements, each color with itself, each color with the other two color components, and each color with white.

This requires a total of 12 EOTF functions estimated for an RGB display. From the 12 EOTF functions, the system can determine crosstalk corrections for any input signal combination. EOTF functions typically have input levels ranging from 0 to 1 and output levels ranging from 0 to peak brightness (K). The generation of the XYZ to RGB conversion matrix is based on the purity of the primary colors and the max output of each color creating the native color of white. Therefore, when R'=G'=B'=1, normalizing the EOTF, such as at 80 for red, to create R=G=B=1 uses a single scaling factor.

Figure 5:
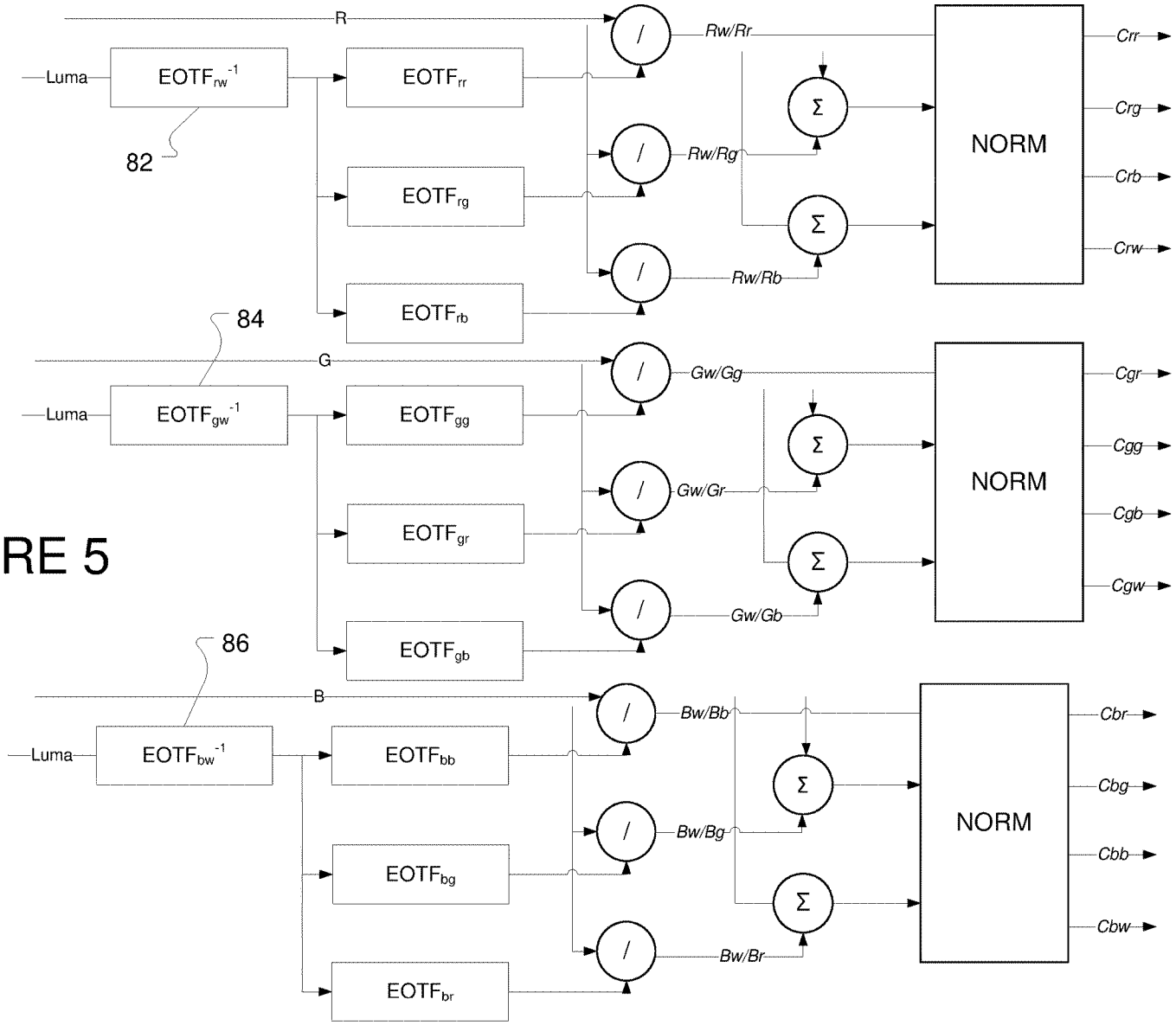
FIG. 5 shows an alternative embodiment of modeling a non-linear response for colors in an input color space.

FIG. 4 demonstrates the crosstalk correction for a color component calculated based on the value of that color component. Alternative calculations could use the luma value, the average component value, or the max component value for the pixel. As shown in FIG. 5, the luma inputs are used as alternative inputs to the inverse EOTF functions 82, 84, and 86. The rest of the process would occur as in FIG. 4.

Returning to FIG. 4, to calculate the crosstalk components, the process first calculates the 12 EOTFs. In one embodiment, the process takes at least two different measurements for each color. The system measures the output of a dark version of the color where the input color components approximately equals to 0.5 and a bright version of the color where the input color components approximately equals 1.0. In this embodiment, the process calculates a gamma parameter (γ).

In the following discussion the calculations using the red channel will be discussed. As can be seen in FIG. 4, the other channels are calculated in a similar manner. Using the red channel as an example, the two outputs are:

$R(x)=K*x^{\gamma}$, where $0<x<y$;

$R(y)=K*y^{\gamma}$ where $x<y<=1$;

$R(x)/R(y)=x^{\gamma}/y^{\gamma}=(x/y)^{\gamma}$; and $\gamma=\log(R(x)/R(y))/\log(x/y)$, where x is the intermediate value approximately equal to 0.5, and y is the saturated value approximately equal to 1. If the panel has a large deviation from the ideal gamma for saturated values, y may be adjusted to a lower number such as 224/255. If one wanted to determine the gamma for red when yellow is displayed, where yellow is red plus green:

$R_g(x)=K*x^{\gamma rg}$, where $0<x<y$, (in this embodiment $x=0.5$.

$R_g(y)=K*y^{\gamma rg}$ where $0x<y<=1$;

$R_g(x)/R_g(y)=x^{\gamma rg}/y^{\gamma rg}=(x/y)^{\gamma rg}$; and $\gamma_{rg}=\log(R_g(x)/R_g(y))/\log(x/y)$.

After determination of the gamma parameters, the process can estimate EOTFs as shown below for the red component:

Red when displaying red=$Rr$=$EOTF_{rr}(R')=K_{rr}*R'^{\gamma rr}$;

Red when displaying yellow=$Rg$=$EOTF_{rg}(R')=K_{rg}*R'^{\gamma rg}$;

Red when displaying magenta=$Rb$=$EOTF_{rb}(R')=K_{rb}*R'^{\gamma rb}$;

Red when displaying white=$Rw$=$EOTF_{rw}(R')=K_{rw}*R'^{\gamma rw}$.

One should note that some displays, such as LCD's, may have similar gamma values for a given component. When that occurs, then dark versions of the primary and secondary colors do not require measurement. Instead, the system can use the gamma calculated for the white and gray inputs. That is:

$\gamma rr=\gamma rg=\gamma rb=\gamma rw$.

This allows the total number of measurements required to calculate the EOTFs to reduce from 14 to 5. While the above shows the EOTF modeled as a power function, one skilled in the art will realize that the process may also use other functions. Two examples of other functions are the hybrid log gamma (HLG) used for HDR transmission in Europe and Perceptual Quantizer (PQ) used in the United States.

Figure 6:
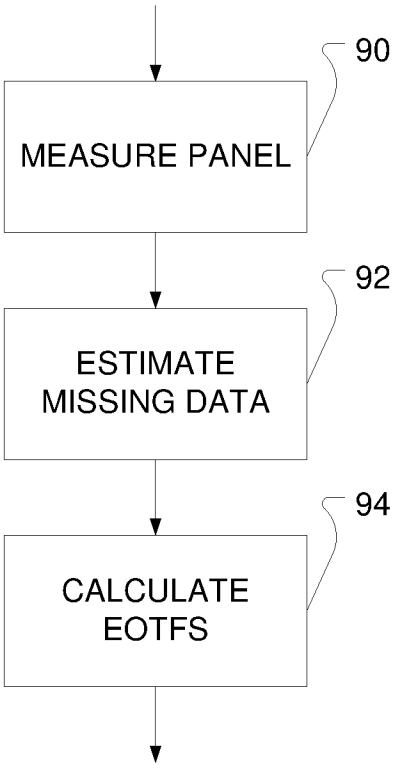
FIG. 6 shows an embodiment of a process to model a display with a reduced number of measurements.

Generally, the process can use a model of the display technology to allow even a smaller set of measurements to generate the 12 EOTF functions. As shown in FIG. 6, one embodiment measures the panel at 90, generates the missing data based on a model of a panel at 92, and generates the EOTFs used to model the non-linear crosstalk 94.

For example, if both the non-linear EOTF's calculated for the white and gray inputs and the gamma for the pure RGB colors are available, then the missing EOTF's could be estimated by a combination of the two EOTF's. That is, in the case when the EOTF is a power function we can estimate the missing gammas for the red component as:

$\gamma rg=w1*\gamma rw+w_2*\gamma rr$, where $1=w_1+w_2$;

$\gamma rb=w3*\gamma rw+w_4*\gamma rr$, where $1=w_3+w_4$.

The weights ($w_i$) above being determined by either measuring several panels and running a linear regression or calculating based on the panel technology.

The process then calculates gains to correct the cross talk. The crosstalk adjustment should have no impact when displaying the native color of white. In other words, the sum of the gains in the crosstalk dot product should equal 1. In the below equations the letter "C" with subscripts represents crosstalk gains.

$R_{out}=C_{rr}*R+C_{rg}*G+C_{rb}*B$ where $C_{rr}+C_{rg}+C_{rb}=1$;

$G_{out}=C_{gr}*R+C_{gg}*G+C_{gb}*B$ where $C_{gr}+C_{gg}+C_{gb}=1$;

$B_{out}=C_{br}*R+C_{bg}*G+C_{bb}*B$ where $C_{br}+C_{bg}+C_{bb}=1$.

However, the above assumes independence of the crosstalk effect from the adjacent colors, which may not always be true. If they are not independent, one option would add a correction term that forces the relationship to be true for white. Furthermore, the correction should work regardless of the amplitude of white. The min function of the RGB components satisfies that condition. This results in:

mRGB=min(R, G, B);

$R_{out}=C_{rr}*R+C_{rg}*G+C_{rb}*B+C_{rw}*\text{mRGB}$, where $C_{rw}=1-C_{rr}+C_{rg}+C_{rb}$;

$G_{out}=C_{gr}*R+C_{gg}*G+C_{gb}*B+C_{bw}*\text{mRGB}$, where $C_{rw}=1-C_{gr}+C_{gg}+C_{gb}$;

$B_{out}=C_{br}*R+C_{bg}*G+C_{bb}*B+C_{gw}*\text{mRGB}$, where $C_{bw}=1-C_{br}+C_{bg}+C_{bb}$.

The generation of the gain components above is based on the goals for calibration and the measurements. First, the process calculates the gain that adjusts a pure color input to a color value that results in the same brightness for that component when the input is white. For example, if G=B=0, then $R_{out}$ results in an output of $R_r$, but the output needs to be $R_w$. Therefore, the gain required is:

$$R_w = C'_{rr} * R_r, \text{ or}$$

$$C'_{rr} = R_w / R_r,$$

where $R_w$ is the measurement of red when displaying white and $R_r$ is the measurement of red when displaying red. FIG. 4 shows this as the output of 70.

The process then needs to calculate the crosstalk gain when the green component is present at 72 and then 76 in FIG. 4. This gain adjusts the red component of the color when displaying yellow to the same value when the input is white, less the already applied gain needed to adjust the red component of the color when the input is red. This represents the adjustment required because green was added to the pure red color.

$$C'_{rg} = R_w / R_g - R_w / R_r, \text{ and similarly,}$$

$$C'_{rb} = R_w / R_b - R_w / R_r \text{ at } \mathbf{74} \text{ and } \mathbf{78} \text{ in FIG. } \mathbf{4}.$$

In an embodiment that does not use the minimum of RGB as part of the crosstalk correction, assuming that the crosstalk functions are independent of the other color components, the sum needs to equal one. The normalization process 80 normalizes the results by:

$$C_{rr} = C'_{rr} / (C'_{rr} + C'_{rg} + C'_{rb})$$

$$C_{rg} = C'_{rg} / (C'_{rr} + C'_{rg} + C'_{rb})$$

$$C_{rb} = C'_{rb} / (C'_{rr} + C'_{rg} + C'_{rb})$$

Without normalization, the gains would be:

$$C_{rr} = C'_{rr}$$

$$C_{rg} = C'_{rg}$$

$$C_{rb} = C'_{rb}$$

$$C_{rw} = 1 - C'_{rr} - C'_{rg} - C'_{rb}.$$

The above equations show how to calculate crosstalk for correction in the linear domain, similar equations using non-linear R'G'B' values as inputs, eliminating the $EOTF^{-1}$ (FIG. 4, box 58, 60, and 62) and then combining it with the EOTF's (FIG. 4, box 64, 66, and 68) could also calculate the crosstalk gains. For example, if the EOTF's are described by a gamma function, then we can replace the $EOTF_{rr}$ in 84 with a function that accepts a non-linear input and produces a non-linear output:

$$EOTF_{rw}^{-1} = R^{1/\gamma rw}$$

$$EOTF_{rr} = R^{\gamma rr}$$

$$R'_r = ((R'_in)^{\gamma rr})^{1/\gamma rw}$$

This would be used in a system where the input has already been converted to the panel color space as shown in FIG. 1 or if a small enough difference exists between the color spaces, the crosstalk correction could also occur in the input color space.

Most crosstalk mechanisms occur when the signal is proportional to the light output. A current determines the light output in an LED device in an almost linear relationship. Therefore, the light output from an OLED display is approximately proportional to the current through the LED, resulting in the output from the display drive electronics being approximately proportional to the light output. This implies that the crosstalk that occurs between the output of the display driver and the light output of the LED occurs on a linear representation of the color and therefore compensation should be applied to the linear version of the RGB values. For LCD panels, crosstalk can occur because of the physical separation between the liquid crystal light valve and the color filter. This can allow unfiltered light to leak from one sub pixel to another. Again, this process would occur in the linear domain.

However, the amount of crosstalk caused by the other color components may not have a linear relationship to the value of that color. For example, the amount of crosstalk could relate to the voltage across a diode which has a non-linear relationship to the current. To model this, a non-linear operation transforms the linear components and the process uses those transformed values to calculate the impact on the component of interest. In the embodiments here, the process models the non-linear relationship using a power function. Alternative non-linear functions are also possible, with the only constraint being that for R=G=B=0, $R_p = G_p = B_p = 0$, and for R=G=B=1, $R_p = G_p = B_p = 1$, allowing the previously derived crosstalk model to remain valid. For example, an s-curve function may fit better if the signal driving the display active matrix also has an s-curve type of relationship. Using the power function model makes the final relationship:

$$R_{out}^{\gamma p} = C_{rr} * R'^{\gamma r} + C_{rg} * G'^{\gamma p} + C_{rb} * B'^{\gamma p}.$$

But the $R_{out}$ is now based on adjusted values, so the process needs to normalize it so that it represents a gain that can be applied to the linear version. That is:

$$\text{Red_Gain} = R_{out}^{\gamma p} / R'^{\gamma p} = CG_{rr} - G_{rg} * G'^{\gamma p} / R'^{\gamma p} + G_{rb} * B'^{\gamma p} / R'^{\gamma p}; \text{ and}$$

$$\text{Rout} = \text{R} * \text{Red_Gain}.$$

The final gain calculated provides the correct amount of adjustment to the red component so that when it is displayed is has the same brightness independent of the other two color components.

One method of determining the non-linear function used to transform the linear components is to first choose a model for a transformation based on the panel technology, such as the power function above, and then determine the parameter(s) that minimize the errors. One could do this by constructing a minimization function, such as least squares, by trial and error, or theoretical calculations of the crosstalk mechanism. Given that the parameters are only determined once and that what matters are perceptual errors, which are non-linear functions of the measured error, using trial and error appears to work the best. In this process, one would pick a value for the gamma ($\gamma_p$) and then analyze the results to see how effectively it reduces the errors for colors that have intermediate levels of saturation.

When determining the EOTFs used for the crosstalk process, the components could only take on two values for a given color and at least one of the components needs to be zero. To determine the impact of the panel characteristics, one wants to minimize the error for lower levels of saturation in addition to the higher levels of saturation used in the measurements for crosstalk.

For example, for the red channel, the process determines the EOTF for crosstalk by looking at the brightest, most saturated colors that include red, meaning red, yellow and magenta, and a darker, but still most saturated versions of the colors, meaning dark red, dark yellow, and dark magenta. To figure out the panel characteristics, the process needs to measure the colors that still contain 100% red, but also have other levels of the other colors, meaning light red, orange, red magenta, light yellow, and light magenta. The goal is to find a function to transform the component values so that when the process applies the crosstalk correction function, it minimizes the errors for all the different combinations of colors produced by having each component take on its maximum value, its minimum value (0), and an intermediate value, such as 0.5. This requires 24 colors, 3 components * 2 other components raised to 3 possible values, or $3*2^3=24$. These values are used to determine the panel parameters. During calibration, the process only measures 12 colors because it assumes that the panel parameters come from the characteristics of the panel that do not vary. The table below shows the various values for the colors:

| Color | Red | Green | Blue |
|---|---|---|---|
| Red | 1 | 0 | 0 |
| Dark Red | 0.5 | 0 | 0 |
| Yellow | 1 | 1 | 0 |
| Dark Yellow | 0.5 | 0.5 | 0 |
| Magenta | 1 | 0 | 1 |
| Dark Magenta | 0.5 | 0 | 0.5 |
| Light Red | 1 | 0.5 | 0.5 |
| Red Magenta | 1 | 0 | 0.5 |
| Light Yellow | 1 | 1 | 0.5 |
| Light Magenta | 1 | 0.5 | 1 |

Again, it should be noted that while 1, 0.5 and 0 are used in the table above, they actual represent 3 values that are close to 0, close to 0.5 and close to 1.

Several of the non-linear functions described above may be implemented using one-dimensional (1D) lookup tables (LUT) by pre-calculating the values. In addition, the entire conversion from in the input R'G'B' to the crosstalk compensated outputs R'G'B' that are sent to the display could also be pre-calculated and stored in a 3D LUT.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of calibrating a display panel, comprising:

making measurements of each color component displayed on the display panel;

using the measurements to generate at least two non-linear models for each color component;

receiving an input image consisting of one or more pixels represented by input color values;

calculating at least two crosstalk gains for a given value of the color components using a ratio of the generated non-linear models and the input values of a pixel;

applying the crosstalk gains to the color components of the pixel to create crosstalk compensated component values; and displaying an image using the crosstalk compensated component values.

2. The method of claim 1, wherein making measurements comprises making measurements of each color when each color is displayed, of each color when other colors are displayed, and of each color when white is displayed.

3. The method of claim 1, wherein using the measurements to generate at least two non-linear models for each color component comprises:

calculating gamma values for each color component using at least two measurements for each color component ; and using the gamma values and a full intensity measure to generate the non-linear models.

4. The method of claim 3, wherein the gamma values for each color are similar enough to allow at least some of the measurements to be estimated, reducing a number of measurements needed to generate the at least two non-linear models.

5. The method of claim 1, wherein at least one of the non-linear models for each color is estimated based on the average measurement of several panels.

6. The method of claim 1, wherein at least one of the non-linear models for each color is estimated based on the panel technology.

7. The method of claim 1, wherein applying the crosstalk gain is also based on a model of a crosstalk mechanism in the panel to transform the color components.

8. The method of claim 7 wherein the crosstalk mechanism is determined by making measurements of several panels.

9. The method of claim 7, wherein the crosstalk mechanism is determined by the panel technology.

10. The method of claim 1, further comprising storing the crosstalk gains in a one-dimensional look up table.

11. The method of claim 1, wherein the calculating and applying the crosstalk gains comprises using a three-dimensional lookup table.

12. The method of claim 1, wherein using the measurements to generate at least two non-linear models for each color component uses one of a power function, or an s-curve function for a panel crosstalk model.

13. The method of claim 1, wherein using the measurements to generate at least two non-linear models for each color component uses one of a gamma function, hybrid log gamma function or a perceptual quantizer function for non-linear models.

* * * * *